US007189131B2

(12) United States Patent
Kotter et al.

(10) Patent No.: US 7,189,131 B2
(45) Date of Patent: Mar. 13, 2007

(54) HIGH BUFFER GAS PRESSURE CERAMIC ARC TUBE AND METHOD AND APPARATUS FOR MAKING SAME

(75) Inventors: Stefan Kotter, Hamilton, MA (US); Gregory Zaslavsky, Marblehead, MA (US); Fred Whitney, Salem, MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 11/132,958

(22) Filed: May 19, 2005

(65) Prior Publication Data

US 2005/0208865 A1 Sep. 22, 2005

Related U.S. Application Data

(62) Division of application No. 10/767,047, filed on Jan. 29, 2004, which is a division of application No. 10/077,447, filed on Feb. 15, 2002, now abandoned.

(60) Provisional application No. 60/270,850, filed on Feb. 23, 2001.

(51) Int. Cl.
*H01J 9/32* (2006.01)

(52) U.S. Cl. ..... 445/26; 445/70; 445/73; 313/317; 313/634

(58) Field of Classification Search ..... 445/26, 445/70, 73; 313/634, 635, 317, 623–625
See application file for complete search history.

(56) References Cited

U.S. PATENT DOCUMENTS 3,424,629 A * 1/1969 Ernst et al. ..... 117/98
3,628,846 A * 12/1971 Cortorillo ..... 445/26
4,179,037 A 12/1979 Chan et al. ..... 220/2.3 R
4,342,939 A 8/1982 McVey ..... 313/174
4,704,093 A 11/1987 Morris ..... 445/26
4,707,636 A 11/1987 Morris ..... 313/625
4,736,136 A 4/1988 Persiani et al. ..... 313/625
4,868,457 A * 9/1989 Strok ..... 313/625
4,910,432 A * 3/1990 Brown et al. ..... 313/620
5,001,396 A * 3/1991 Snellgrove et al. ..... 313/625
5,057,048 A 10/1991 Feuersanger et al. ..... 445/44
5,138,231 A 8/1992 Iida et al. ..... 313/73
5,178,808 A 1/1993 Makar et al. ..... 264/60
5,188,554 A 2/1993 Snellgrove et al. ..... 445/26
5,208,509 A 5/1993 Snellgrove et al. ..... 313/623
5,248,913 A 9/1993 Heider ..... 313/25
5,252,886 A 10/1993 Renardus et al. ..... 313/44
5,288,255 A 2/1994 Brabham et al. ..... 445/26
5,343,117 A 8/1994 Wyner et al. ..... 313/623

(Continued)

FOREIGN PATENT DOCUMENTS

EP 0 957 007 A1 11/1999

(Continued)

*Primary Examiner*—Mariceli Santiago
*Assistant Examiner*—Christopher M. Raabe
(74) *Attorney, Agent, or Firm*—Robet F. Clark

(57) ABSTRACT

A ceramic arc tube for high intensity discharge (HID) lighting applications is provided wherein the arc tube contains a high buffer gas pressure. A method and apparatus for making the arc tube are also provided wherein RF induction heating is used to melt a frit material to form a hermetic seal.

5 Claims, 6 Drawing Sheets

U.S. PATENT DOCUMENTS

| | | | | |
|---|---|---|---|---|
| 5,382,873 | A | 1/1995 | Scholl et al. | 313/570 |
| 5,404,078 | A | 4/1995 | Bunk et al. | 313/625 |
| 5,424,609 | A | 6/1995 | Geven et al. | 313/623 |
| 5,592,048 | A | 1/1997 | Wei et al. | 313/570 |
| 5,592,049 | A | 1/1997 | Heider et al. | 313/625 |
| 5,600,204 | A | 2/1997 | Jacobs et al. | 313/572 |
| 5,783,907 | A | 7/1998 | Suzuki et al. | 313/625 |
| 5,905,341 | A | 5/1999 | Ikeuchi et al. | 313/369 |
| 5,973,453 | A | 10/1999 | Van Vliet et al. | 313/623 |
| 6,066,918 | A | 5/2000 | Suzuki et al. | 313/623 |
| 6,137,230 | A | 10/2000 | Born et al. | 313/638 |
| 6,404,129 | B1 * | 6/2002 | Hendricx et al. | 313/620 |
| 6,566,817 | B2 | 5/2003 | Lapatovich | 315/85 |

FOREIGN PATENT DOCUMENTS

| | | |
|---|---|---|
| EP | 0 971 043 A2 | 1/2000 |
| WO | WO 00/67294 | 11/2000 |

* cited by examiner

HIGH BUFFER GAS PRESSURE CERAMIC ARC TUBE AND METHOD AND APPARATUS FOR MAKING SAME

CROSS REFERENCES TO RELATED APPLICATIONS

This application is a divisional of application Ser. No. 10/767,047, filed Jan. 29, 2004, which is a divisional of application Ser. No. 10/077,447, filed Feb. 15, 2002 now abandoned, which claims the benefit of U.S. Provisional Application No. 60/270,850, filed Feb. 23, 2001. This application is related to commonly-owned applications Ser. Nos. 09/841,414 and 09/841,424 both filed Apr. 24, 2001, now U.S. Pat. No. 6,566,814, issued May 20, 2003, and U.S. Pat. No. 6,641,449, issued Nov. 4, 2003, respectively.

TECHNICAL FIELD

This invention relates to ceramic arc tubes having high buffer gas pressures and methods for sealing said arc tubes with a frit material. The invention further relates to a radio-frequency (RF) induction heating method and apparatus.

BACKGROUND OF THE INVENTION

Ceramic arc tubes for high-intensity discharge (HID) lamps are well known. One of the more common configurations of these arc tubes includes an axially symmetric discharge vessel having opposed capillary tubes extending outwardly from each end. These capillary tubes have an electrode assembly sealed therein to provide the electrical energy needed to strike an arc discharge inside the discharge vessel. The ends of the capillaries are sealed hermetically to the electrode assemblies with a frit material. The discharge vessel contains an ionizable fill material which usually comprises some combination of metal halide salts and/or mercury. A buffer gas is added to promote arc ignition and influence the lamp's photometric properties and longevity. The typical buffer gas is one of the noble gases, e.g., argon, xenon, krypton, or a mixture thereof. Generally, the buffer gas pressures of ceramic arc tubes are less than about 1.5 bar. Examples of such arc tubes are described in U.S. Pat. Nos. 5,973,453 and 5,424,609, and European Patent Nos. 0 971 043 A2 and 0 954 007, all of which are incorporated herein by reference.

The conventional frit-sealing processes for ceramic arc tubes take place in low-pressure chambers, <1 bar, and employ resistive heating elements made of tungsten or graphite. The use of resistive heating necessitates bulky feedthroughs to accommodate the high electrical currents, complicated shielding, and forced water cooling. As a result, the conventional production equipment is usually large, slow, expensive and inefficient. The large sealing chambers also require larger volumes of buffer gas which increase manufacturing costs. In addition, a majority of heating energy is consumed by the apparatus itself which extends the time needed to reach the sealing temperature. The heat loss problem is exacerbated further when dealing with high buffer gas pressures because of the extra heat losses due to gas convection and increased heat transfer. Thus, there are a number of difficulties which must be overcome to obtain a ceramic arc tube having a high buffer gas pressure, i.e., >1 bar.

In contrast to ceramic arc tubes, fused silica (quartz) arc tubes have been employed with buffer gas pressures as high as 8 bar. In order to meet the high pressure requirement, a freeze-out technique is usually employed wherein one end of the quartz arc tube is immersed in liquid nitrogen to liquify or solidify the buffer gas in the discharge volume while the other end is heated to a high temperature which softens the quartz and allows the end to be sealed by a press-sealing or tipping-off method. Upon warming to room temperature, the buffet gas evaporates into a much smaller volume to provide the desired pressure. However, the freeze-out technique is impractical to use with ceramic arc tubes since the press-sealing or tipping-off methods used to seal the ends of quartz arc tubes are unavailable for use with ceramic materials.

SUMMARY OF THE INVENTION

It is an object of the invention to obviate the disadvantages of the prior art.

It is another object of the invention to provide a frit-sealed ceramic arc tube having a buffer gas pressure of at least about 2 bar.

It is a further object of the invention to provide an apparatus and method for making hermetic seals in ceramic arc tubes at high buffer gas pressures.

In accordance with one object the invention, there is provided a ceramic arc tube comprising a discharge vessel having at least one capillary having an electrode assembly, the capillary extending outwardly from the discharge vessel to a distal capillary end, the electrode assembly being hermetically sealed to the distal capillary end with a frit material, the electrode assembly passing through the capillary to the discharge chamber and being connectable to an external source of electrical power, the discharge vessel enclosing a discharge chamber containing a buffer gas and an ionizable fill material, the pressure of the buffer gas being from 2 bar to 8 bar.

In accordance with another object of the invention, there is provided an apparatus for making a ceramic arc tube. The apparatus comprises a pressure jacket having a pressure chamber containing an RF susceptor, the susceptor having an opening for receiving a capillary of the arc tube, an RF induction coil situated external to the pressure jacket and surrounding the RF susceptor, the RF induction coil being connected to an RF power source;

the pressure chamber being connected to a source of pressurized buffer gas and a vacuum source, the source of pressurized buffer gas being regulated by a valve connected to a pressure controller having a pressure sensor for measuring the pressure in the pressure chamber;

a holder having a support for the arc tube, the height of the support being selected to cause an unsealed end of the arc tube to be positioned within the RF susceptor when the holder is sealed to the apparatus; and the apparatus when sealed being capable of alternately evacuating the pressure chamber and filling the pressure chamber with buffer gas.

In accordance with still another object of the invention, there is provided a method for sealing a ceramic arc tube comprising:

(a) sealing the arc tube within a pressure chamber, the arc tube comprising a discharge vessel and at least one capillary, the capillary extending outwardly from the discharge vessel to a distal capillary end having a frit material, the chamber containing an RF susceptor surrounding the distal capillary end;

(b) filling the chamber with a buffer gas to a predetermined pressure; and (d) heating the RF susceptor by energizing an RF induction coil with an RF power source, the RF induction coil being external to the chamber and surrounding the RF susceptor, the heat generated by the RF susceptor causing the frit material to melt and flow into the distal capillary end; and (e) cooling the frit material to form a hermetic seal.

DETAILED DESCRIPTION OF THE INVENTION

For a better understanding of the-present invention, together with other and further objects, advantages and capabilities thereof, reference is made to the following disclosure and appended claims taken in conjunction with the above-described drawings.

It has been discovered that ceramic arc tubes having high buffer gas pressures may be made with a radio-frequency (RF) induction sealing method and apparatus. Although the method of this invention may be used to seal a variety of ceramic arc tube configurations, a preferred ceramic arc tube configuration has at least one capillary extension containing an electrode assembly wherein the capillary is hermetically sealed with a frit material. The RF sealing apparatus comprises a resealable pressure chamber having an RF induction heater mounted at one end. The RF induction heater is comprised of an RF power supply, an RF induction coil located external to the pressure chamber, and an RF susceptor located within the pressure chamber. In order to seal the capillary end, the arc tube is oriented within the pressure chamber so that the capillary end to be sealed is contained within RF susceptor. The sealed pressure chamber is evacuated and then filled with the buffer gas to the desired pressure. RF power is applied and the RF susceptor absorbs the energy generated by the RF induction coil causing the susceptor to heat up. The thermal radiation emitted by the hot susceptor causes the frit material located adjacent to the open end of the capillary to melt and flow down along the electrode assembly thereby sealing the end of the capillary.

Figure 1:
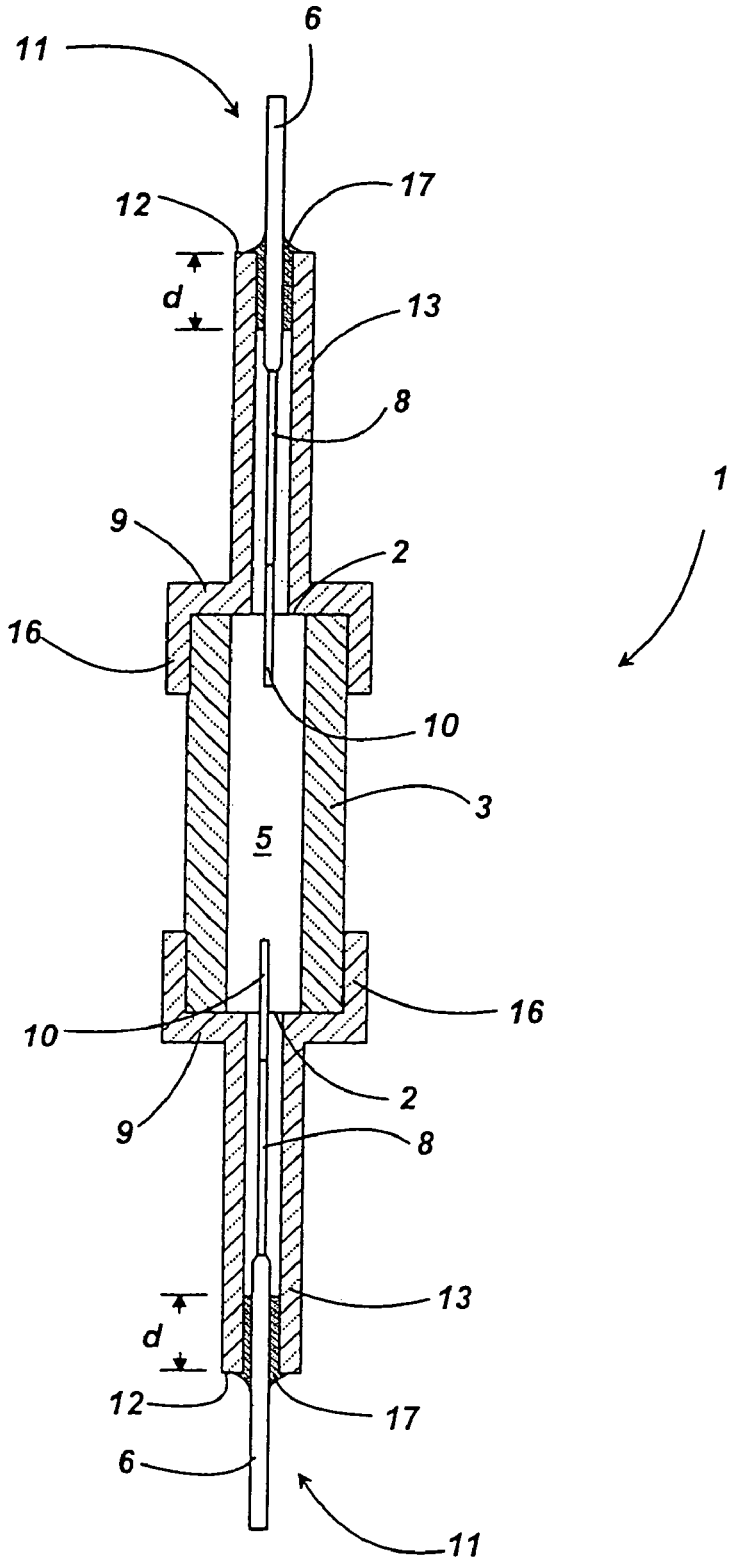
FIG. 1 is a cross-sectional view of a sealed ceramic arc tube of this invention.

A cross-sectional view of a preferred frit-sealed ceramic arc tube having a high internal buffer gas pressure is shown FIG. 1. The axially symmetric arc tube 1 is comprised of discharge vessel 3, discharge chamber 5, opposed end caps 9, and electrode assemblies 11. Discharge vessel 3 is comprised of a sapphire tube. Although sapphire is preferred, the discharge vessel may be made of other ceramic materials including in particular polycrystalline alumina and yttrium aluminum garnet. End caps 9 have an annular rim 16 which is designed to fit over the open ends 2 of the discharge vessel. Preferably, the end caps are made of a polycrystalline alumina and are hermetically sealed to the discharge vessel by a conventional sintering method. The discharge vessel 3 in combination with end caps 9 enclose discharge chamber 5 which contains an ionizable fill material (not shown).

Each end cap 9 has a capillary 13 which extends outwardly from discharge vessel 3 to a distal end 12. Each capillary 13 contains an electrode assembly 11 which is hermetically sealed in the capillary by frit 17. Such frit materials for sealing ceramic arc tubes are well known. A preferred frit material for the RF-sealing method consists of 65% $Dy_2O_3$, 25% $SiO_2$, and 10% $Al_2O_3$ by weight. However, the invention is not limited to any particular frit composition.

In a more preferred configuration, the electrode assembly 11 is comprised of a niobium feedthrough 6 which is welded to a threaded molybdenum rod 8 which in turn is welded to a tungsten electrode 10. Other electrode configurations such as are well known in the art may be used provided that the electrode assembly may be sealed in the capillary by a frit material. The frit penetration depth d into the distal end of the capillary affects the quality of the seal and must be empirically determined for each arc tube configuration. When a niobium feedthrough is used, the frit should penetrate deep enough to cover and protect the niobium since niobium generally reacts with the aggressive chemicals in the ionizable fill. However, the frit must not get too close to the hot arc tube body as this increases the risk of cracking from any thermal mismatches between the materials.

Once both ends of the arc tube are sealed, the pressurized buffer gas is contained within the discharge chamber 5 of the arc tube. Preferably, the buffer gas is comprised of argon, xenon, krypton or a mixture thereof and the buffer gas pressure within the discharge chamber is from 2 to 8 bar. (It is to be understood that the buffer gas pressures referred to herein are measured at room temperature (about 25° C.) and not at the very high temperatures encountered in an operating arc tube.) In some applications, the buffer gas pressure in the arc tube may range up to 10 bar and it is conceivable that future applications may require buffer gas pressures in excess of 10 bar. Such applications are well within the scope of this invention.

Figure 2:
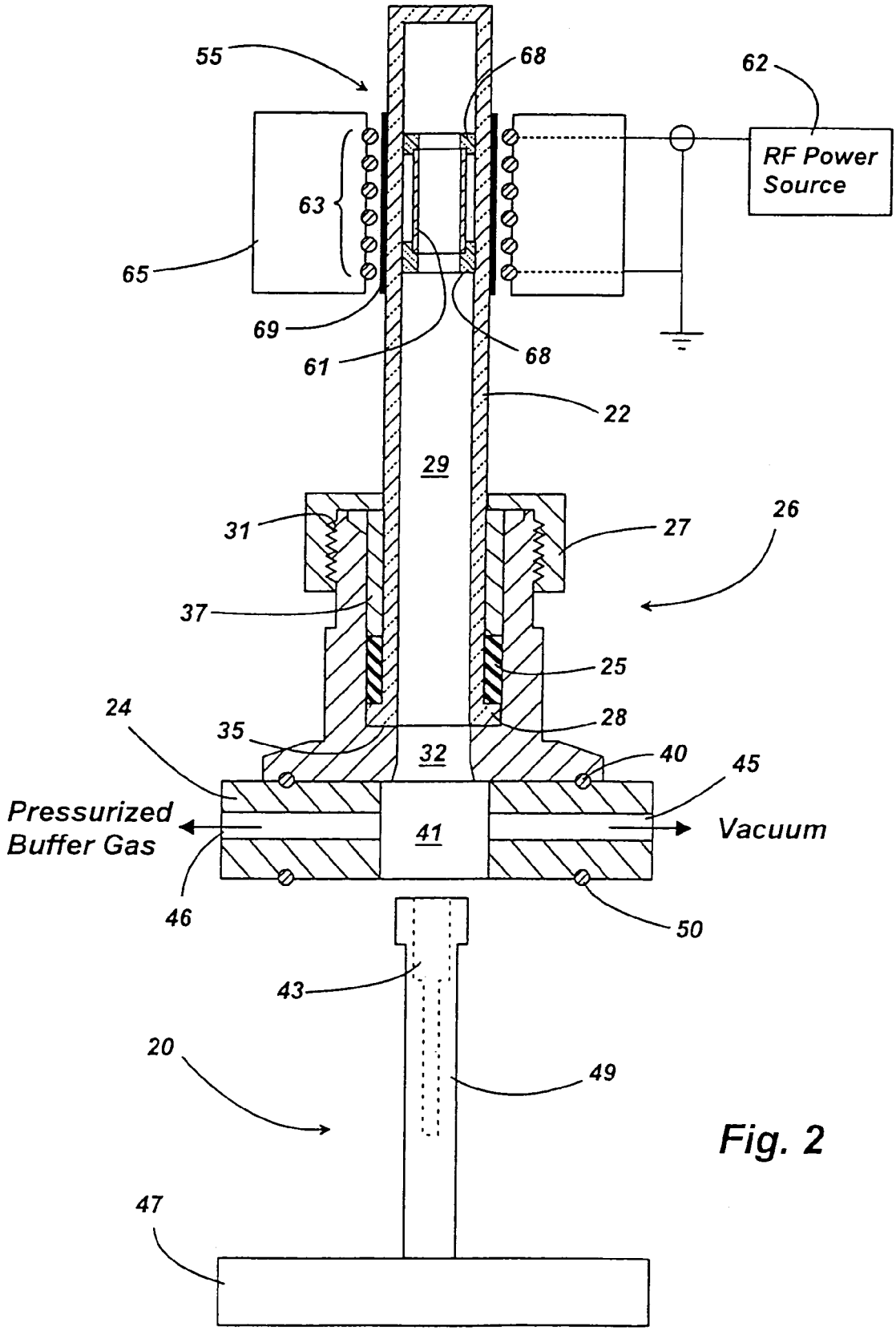
FIG. 2 is a cross-sectional view of the radio-frequency (RF) sealing apparatus of this invention.

An embodiment of the RF induction sealing apparatus is shown in cross section in FIG. 2. The apparatus comprises tubular pressure jacket 22 which is closed at the top and open at the bottom to receive the arc tube to be sealed. Fused silica (quartz) was selected as the material for the pressure jacket because it is a transparent dielectric material capable of withstanding the high temperatures and pressures used in the sealing method. However, the pressure jacket may also be made from appropriate non-transparent ceramic materials and its geometry adapted to accommodate different arc tube shapes.

Positioned inside an upper region 55 of pressure jacket 22 is RF susceptor 61. Susceptor 61 is hollow to receive the capillary end of the arc tube (not shown) and is held in position by alumina spacers 68. In this embodiment, the preferred susceptor is a hollow graphite cylinder. Graphite was selected because of its high susceptibility and emissivity. However other suitable conductive materials (e.g., molybdenum and tungsten) and susceptor geometries may be used. The geometry of the pressure jacket and the susceptor should be adjusted to the size and shape of the capillary extension so that gas convection is impeded. By impeding gas convection, heat losses may be reduced during sealing. In addition, an external thermal shield 69 made of reflecting and insulating materials may be positioned around susceptor 61 to further improve power utilization by reducing heat losses due to radiation and conductance. The shield also helps prevent thermal radiation from reaching the RF induction coil 63 and cooling block 65 thereby reducing cooling requirements. Thermal shields may be comprised of dielectric multi-layer infra-red-reflecting materials or extremely thin metal metals films with gaps parallel to the axis of the chamber to reduce eddy currents.

External RF induction coil 63 surrounds susceptor 61 and is connected to a source of RF power 62. When the induction coil is energized, the susceptor absorbs the RF energy generated by the induction coil and becomes heated. The thermal emission from the heated susceptor in turn causes the frit material to melt and seal the electrode assembly to the capillary. The diameter of the coil is chosen to be as small as possible to reduce the cross-sectional area inside the coil to a minimum with respect to the susceptor. Consequently, a maximum amount of the coil's electromagnetic flux intersects with the cross-sectional areas of the conductive susceptor and electrode system reducing the amount of wasted flux. A further optimization of the induction coil geometry (coil diameter, wire diameter, number of turns, total wire length) to achieve optimal inductance, stored energy in the coil, and electromagnetic flux insures sufficient joule heating of the total load inside the coil for a given input power and heating rate. This reduces power input and coil current to a minimum. The low coil current reduces the joule heating of the coil to such a low value that no water cooling of the coil is necessary.

Instead, induction coil 63 is embedded in a cooling block 65 made of an insulating dielectric material having good heat conduction. The cooling block dissipates the small resistive heating in the coil as well as the thermal radiation and conducted heat from the susceptor. The preferred material for the cooling block is an aluminum nitride/boron nitride composite. The cooling block insures that the temperature and resistance of the coil remain low during the sealing operation. The cooling block also provides added mechanical stability to the coil which helps to maintain the coil in its predetermined shape in order to provide reproducible coupling conditions.

The pressure jacket 22 is sealed to base 26 by elastomeric gasket 25. Base 26 has bore 32 which is open to the pressure chamber 29 of pressure jacket 22 on one side and allows the arc tube to inserted through the base from the opposite side. Open end 31 is threaded to permit cap 27 to be screwed onto the base. Pressure jacket 22 is sealed in the base by inserting the jacket into the base 26 through open end 31 until flange 28 contacts rim 35. Gasket 25 is then placed over the jacket followed by compression spacer 37. Cap 27 which has an aperture sufficient to receive the pressure jacket is then screwed down onto base 26 causing spacer 37 to compress gasket 25 thereby forming a tight seal between the base and the pressure jacket. Since the pressure jacket is releasably sealed to the base, it is easy to adapt the sealing apparatus for use with a variety of different arc tube configurations by simply changing the pressure jacket.

Base 26 is mounted to manifold 24 and sealed thereto by o-ring 40. Manifold 24 has bore 41 there through which is in fluid communication with the pressure chamber 29 through bore 32 of base 26. Bore 41 is connected to a source of vacuum (not shown) through port 45 and to a source of pressurized buffer gas (not shown) through port 46. This allows pressure chamber 29 to be alternately evacuated and pressurized in order to fill an arc tube with the buffer gas. The source of pressurized buffer gas is equipped with a pressure controller (not shown) which monitors and regulates the pressure in chamber 29. The pressure controller is connected to a pressure sensor which measures the pressure in the chamber and a microprocessor-controlled variable valve which permits the pressure in the chamber to be increased at a predetermined rate.

Arc tube holder 20 is comprised of base 47 and support 49. Support 49 has cavity 43 which has a shape corresponding to the end of the arc tube. The sealing apparatus is loaded by seating the arc tube in the support cavity 43 and then raising holder 20 until it is presses and seals against manifold 24 and o-ring 50. Funnel-shaped guides may be placed inside the lower region of the pressure jacket to center and steady the arc tube as it is inserted. The height of support 49 should be established so that the opposite end of the arc tube is appropriately situated within the RF susceptor 61 when the holder 20 is mated to the manifold 24.

Once an arc tube is seated in the holder and the apparatus is sealed, the pressure chamber and, consequently, the discharge chamber of the arc tube are evacuated and then filled with the buffer gas to the desired pressure. The RF power is switched on causing the susceptor to heat up. Once the frit temperature reaches its melting point, the frit liquifies and wets both the ceramic capillary and the electrode assembly. Gravity and capillary forces cause the melted frit to flow down into the distal end of the capillary. Once the frit reaches the desired penetration depth within the capillary, the RF power is switched off and the frit solidifies forming a hermetic seal between the capillary and the feedthrough of the electrode assembly. The chamber pressure can then be reduced to atmospheric pressure and the apparatus opened and reloaded. When making the final seal in the arc tube, there is temperature-related pressure rise in the arc tube as the internal volume of the arc tube becomes separated from the volume of the pressure chamber. To avoid a large pressure differential once the two volumes are separated, the pressure rise in the chamber must match the pressure rise inside the arc tube. It is preferred to use a slightly greater pressure rise in the pressure chamber to insure that the frit will flow down to the desired penetration depth.

Figure 3:
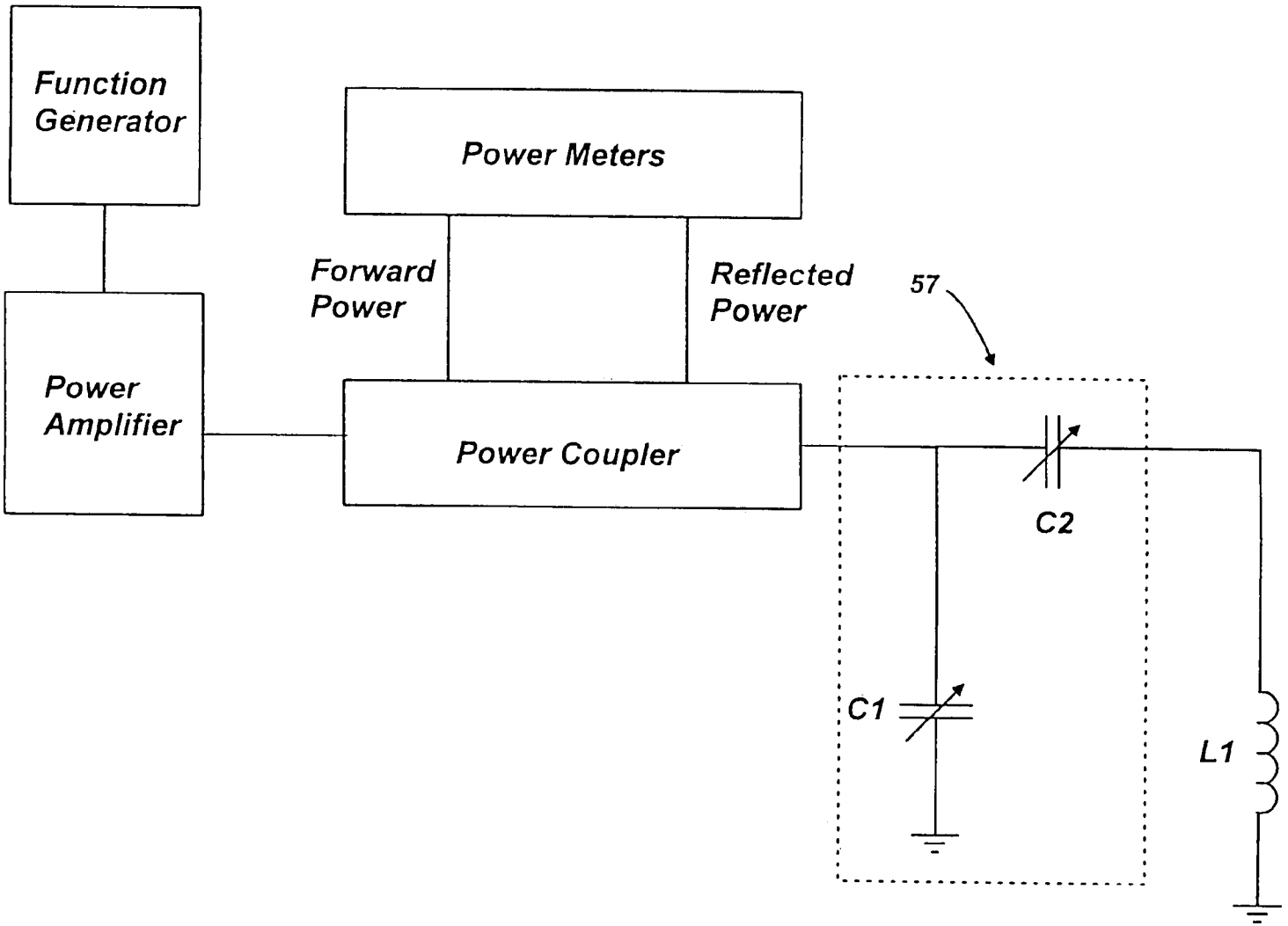
FIG. 3 is a schematic of an RF power supply used with the sealing apparatus of this invention.

In general, the choice of the RF frequency is determined by EMI/RFI emission requirements, the geometry of the parts to be heated, and the desired heating rate. More particularly, the frequency should possess a rate of change in its magnetic field sufficient to induce a current in the susceptor capable of raising the temperature of the susceptor and melting the frit within the required time. Preferably, the RF frequency is 27.12 MHz which is an ISM band requiring only minimal EMI/RFI shielding. A schematic illustration of an RF power source-is shown in FIG. 3. In this embodiment, the induction coil is being driven in a single-ended mode. A suitable RF-matching network 57 is designed to allow connection of the induction coil L1 to the RF power amplifier with a minimum of reflected power. The conductivity and power consumption of the susceptor, the inductance of the coil L1, and the values of the capacitors C1 and C2 are designed and miniaturized in such a way to achieve a coil current on the order of 10 amperes and an RF power source output of less than about 300 watts. The low wattage and optimal coupling adjustment eliminates the need for large RF amplifiers and the low coil current reduces cooling requirements. The combination of these features yields an energy efficient system capable of high heating rates and consequently shortened heating times.

The above-described RF sealing apparatus is usable for filing and sealing arc tubes having buffer gas pressures of at least about 1 bar. Below about 1 bar it becomes difficult to use the sealing apparatus without striking an RF plasma in the chamber. However, by applying certain plasma inhibiting. measures, RF sealing is achievable at pressures less than 1 bar. Such methods include: reducing the maximum coil voltage with respect to circuit ground by driving the induction coil in a differential mode instead of a single-ended mode; blunting the edges of the susceptor to minimize electric field enhancement along the edges; and/or increasing the dielectric creep distance along the susceptor by using high temperature insulating materials to shield or shadow all or part of the susceptor.

Figure 4:
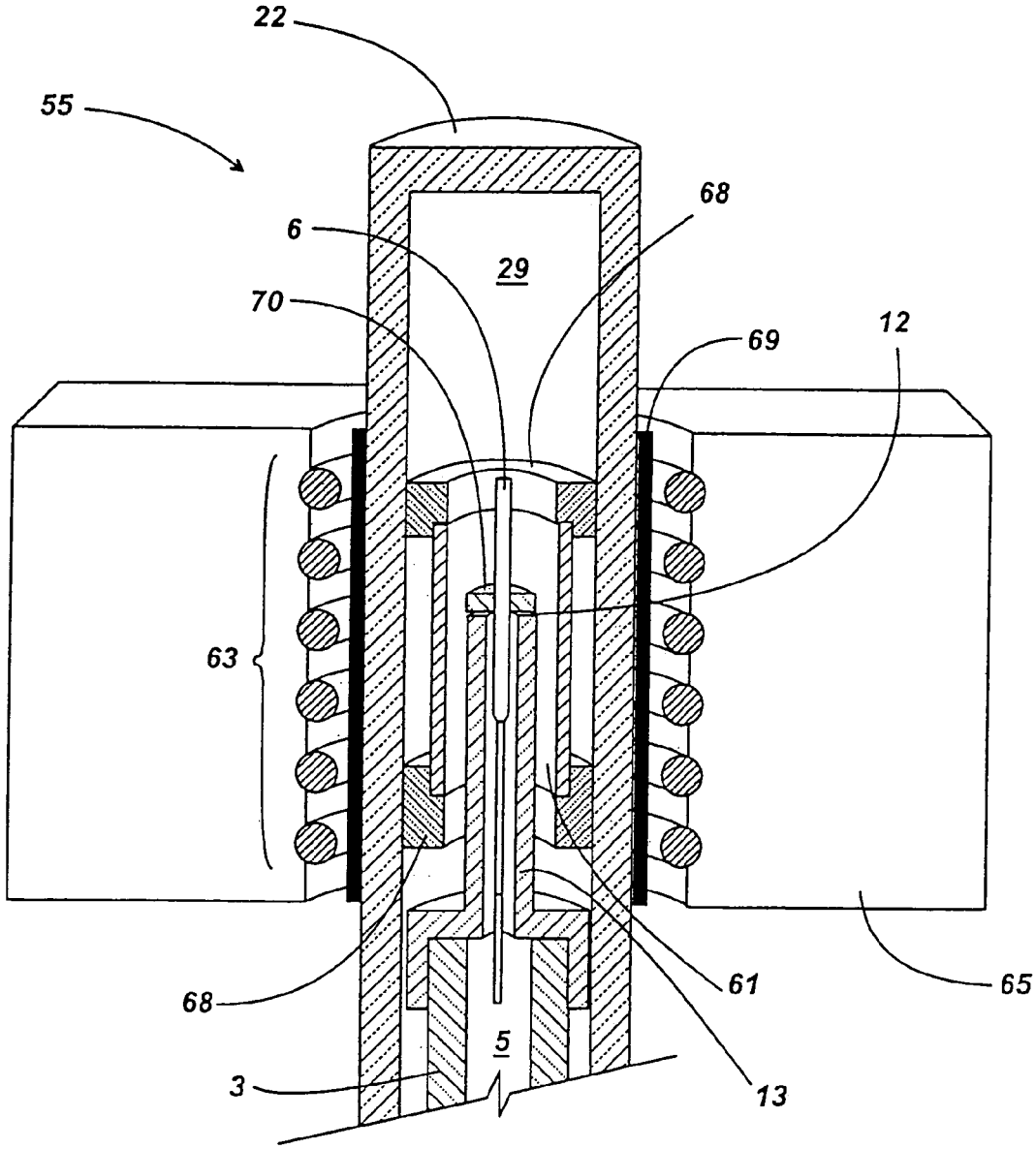
FIG. 4 is a cross-sectional perspective view showing the relationship between the RF induction heater and the capillary end of an arc tube to be sealed.

FIG. 4 is a cross-sectional perspective view of upper region 55 of pressure jacket 22 showing an arc tube capillary 13 ready for sealing. A frit ring 70 has been placed around feedthrough 6 and positioned adjacent to the distal end 12 of the capillary. The distal end 12 of the capillary, the frit ring 70 and the feedthrough 6 are situated inside susceptor 61 which is supported by alumina spacers 68. Since the cross-sectional area and volume of pressure chamber 29 is small, noble gas consumption is kept to a minimum and relatively low forces are exerted even when gas pressures up to 10 bar are used.

As described above, when RF power is supplied to induction coil 63, susceptor 61 absorbs the RF energy making it heat up. The thermal radiation emitted by the susceptor then causes the frit ring 70 to melt. Capillary forces and gravity cause the frit to flow down into the capillary 13 along feedthrough 6. The heating is stopped when the frit reaches its predetermined penetration depth. Upon cooling, a hermetic seal is formed between the frit, capillary and feedthrough. The arc tube is removed from the sealing apparatus, inverted, and reloaded into the apparatus in order to seal the opposite end. The final seal is more difficult to achieve than the first seal because, as the frit flows down into the capillary, the internal pressure of the arc tube begins to rise as the gas becomes constrained within the discharge chamber 5.

Figure 5:
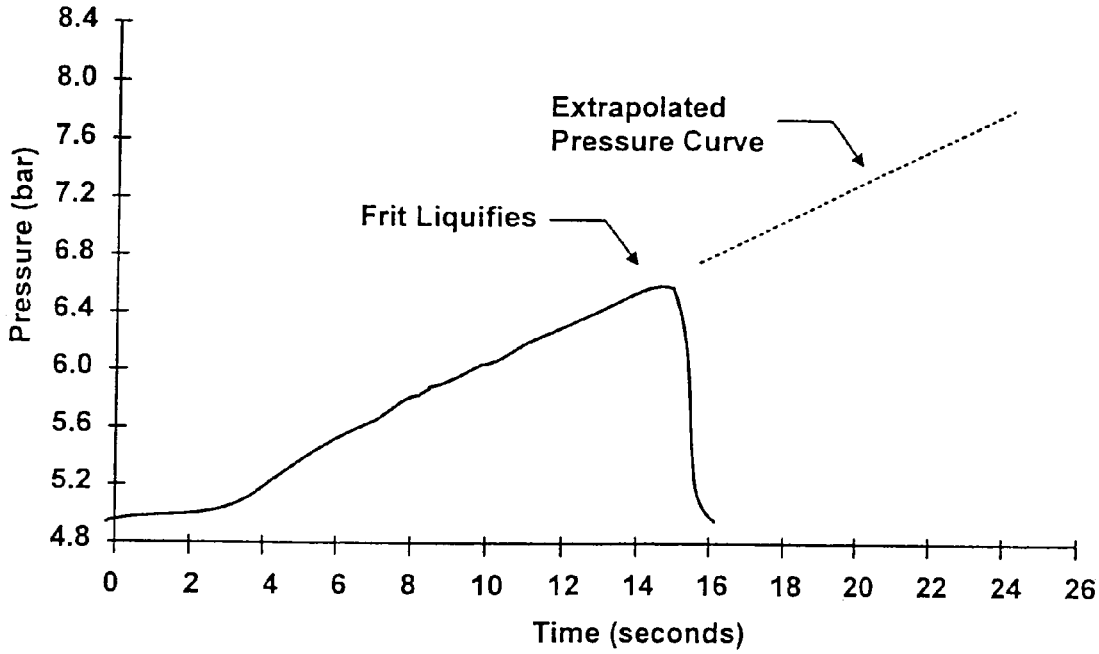
FIG. 5 is a graphical representation of the internal pressure rise in a ceramic arc tube during a sealing cycle.

The pressure rise within the arc tube during a final sealing operation can be empirically determined in a test setup by using a shut-off valve and thin metal capillary glued into the opposite end of the arc tube. The shut-off valve initially connects the discharge chamber to the pressure chamber through the metal capillary allowing both volumes to be filled with buffer gas to the same pressure. The two volumes are then isolated by closing the shut-off valve. A miniature pressure sensor connected to the metal capillary can then be used to monitor the pressure rise in the discharge chamber while the frit-sealed end of the arc tube is heated by the susceptor. As shown in FIG. 5, about 3 seconds after the induction coil is energized, the internal pressure of the arc tube begins to rise linearly. About 15 seconds after the induction coil is energized, the pressure falls abruptly as the frit in the sealed end liquifies. At this point, the internal pressure of the arc tube became sufficient to overcome the external pressure exerted by the gas in the pressure chamber causing the frit seal to fail. Using this information, it is possible to extrapolate the pressure rise within the arc tube throughout the entire sealing cycle. This function can then be used to drive a variable valve to increase the pressure in the pressure chamber at the same rate as the rising pressure inside the arc tube. Moreover, a slight over-pressure differential can be maintained in the pressure chamber to help force the melted frit material into the capillary.

Figure 6:
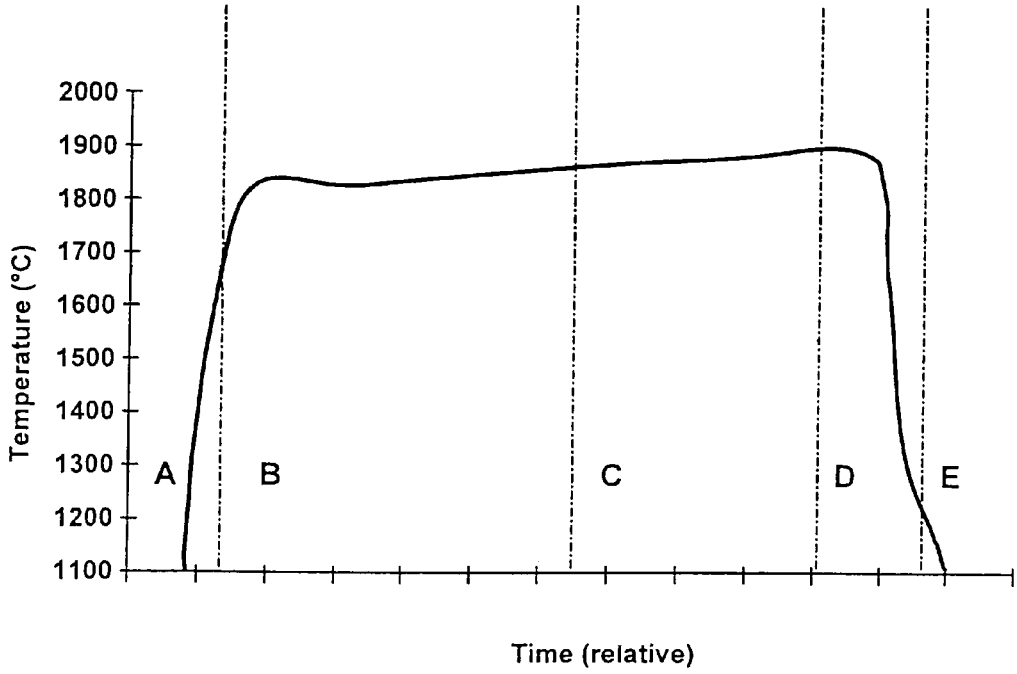
FIG. 6 is a graphical representation of the temperature of the RF susceptor during a sealing cycle.
Figure 7:
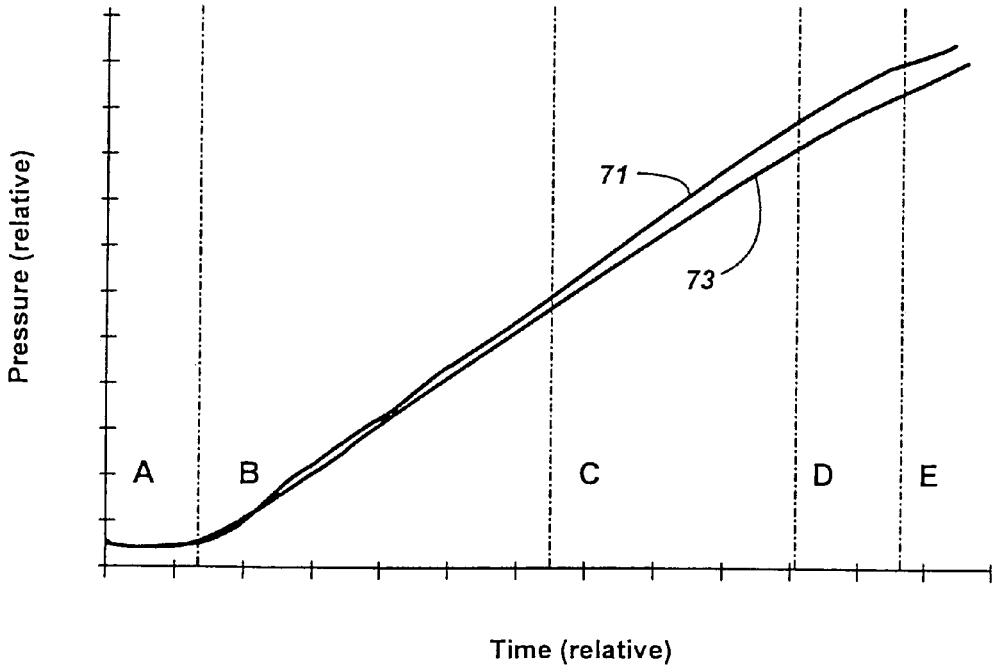
FIG. 7 is a graphical representation of an over-pressure differential applied during the final sealing operation.

FIGS. 6 and 7 illustrate a typical sealing cycle. The temperature of the susceptor during the cycle is shown in FIG. 6. With one end of the arc tube having already been sealed using the same temperature cycle, the forming of the final seal becomes a question of maintaining the pressure balance between the pressure within the arc tube and the pressure inside the pressure chamber. Curve 71 in FIG. 7 represents the pressure within the pressure chamber of the sealing apparatus while curve 73 represents the extrapolated pressure inside the arc tube. Region A marks the beginning of the heating process and is followed by a delayed pressure rise in region B. Frit melting and penetration into the capillary takes place in regions C and D. The end of the heating cycle occurs in region D. The controlled pressure rise in the pressure chamber ends in region E when the frit solidifies and is able to withstand a large pressure differential. The slight over-pressure differential applied during sealing is adjusted empirically to achieve the desired frit penetration depth.

While there has been shown and described what are at the present considered the preferred embodiments of the invention, it will be obvious to those skilled in the art that various changes and modifications may be made therein without departing from the scope of the invention as defined by the appended claims.

We claim:

1. A method for sealing a ceramic arc tube comprising:

(a) sealing the arc tube within a pressure chamber, the arc tube comprising a discharge vessel and at least one capillary, the capillary extending outwardly from the discharge vessel to a distal capillary end having a frit material, the chamber containing an RF susceptor surrounding the distal capillary end;

(b) filling the chamber with a buffer gas to a predetermined pressure of at least 1 bar; and (d) heating the RF susceptor while increasing the pressure of the buffer gas in the chamber at a rate equal to or slightly greater than the pressure of the buffer gas in the discharge vessel, the RF susceptor being heated by energizing an RF induction coil with an RF power source, the RF induction coil being external to the chamber and surrounding the RF susceptor, the heat generated by the RF susceptor causing the frit material to melt and flow into the distal capillary end; and (e) cooling the frit material to form a hermetic seal.

2. The method of claim 1 wherein an overpressure differential in the chamber is used to achieve a frit penetration depth.

3. The method of claim 1 wherein the buffer gas pressure is from 2 bar to 8 bar.

4. The method of claim 1 wherein the buffer gas pressure is from 2 bar to 10 bar.

5. The method of claim 1 wherein the buffer gas pressure exceeds 10 bar.

* * * * *